United States Patent [19]

Paulsen et al.

[11] Patent Number: 4,586,763

[45] Date of Patent: May 6, 1986

[54] ROTATABLE CONNECTOR MECHANISM

[75] Inventors: David C. Paulsen, Santa Clara; William L. Calvert, Sunnyvale; Dennis R. Mitchell, San Jose; Larry D. Gravelle, Mountain View, all of Calif.

[73] Assignee: Grid Systems Corporation, Mountain View, Calif.

[21] Appl. No.: 715,966

[22] Filed: Mar. 25, 1985

[51] Int. Cl.[4] ..... H01R 39/02

[52] U.S. Cl. ..... 339/6 R; 339/4

[58] Field of Search ..... 339/2 R, 2 A, 2 L, 5 R, 339/5 A, 4, 6 R, 6 A, 8 R, 8 A, 17 F, 222; 29/854

[56] References Cited

U.S. PATENT DOCUMENTS 3,601,746 8/1971 Teagno ..... 339/4

3,992,654 11/1976 Springer et al. ..... 339/4 X

FOREIGN PATENT DOCUMENTS 70930 1/1970 German Democratic Rep. ... 339/17 F

*Primary Examiner*—Eugene F. Desmond

*Attorney, Agent, or Firm*—Donald C. Feix

[57] ABSTRACT

A connector component for computer units and peripheral units is secured to the back of each unit and enables the units to be stacked together in direct electrical connection, without the need for cables between them. Each connector component includes a pair of swivel mounts which rotate through 90 degrees and support a multi-contact pin connector, so that each connector can be oriented either vertically or horizontally, toward the rear of the unit. The pin connectors are internally connected to the operable portions of each unit by an internal cable bus. For direct interconnection between units, the adjacent swivel mounts are rotated to the vertical position and mated. At the top and bottom of a vertical stack of units, the extreme upper and lower swivel mounts may be rotated to the horizontal, rearward-facing position for connection to a cable leading to other computer or peripheral units remote from the stack.

32 Claims, 8 Drawing Figures

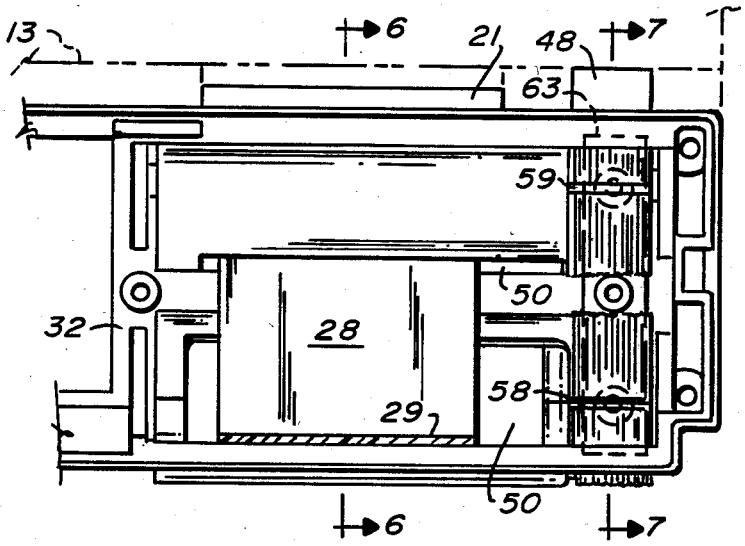
FIG. 5
FIG. 6
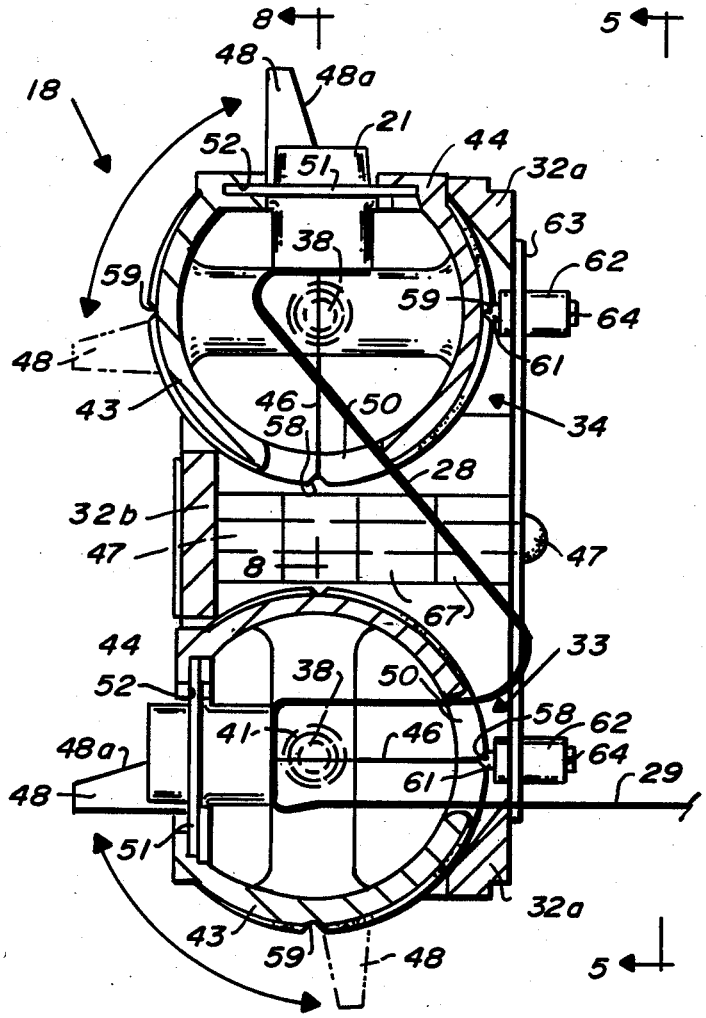

ROTATABLE CONNECTOR MECHANISM

BACKGROUND OF THE INVENTION

The invention relates to electrical components generally, and in particular to a device securable to or within the housing of an electrical component unit for enabling direct electrical connection between units by a stacking of the units.

In electrical and electronic component units, and particularly in computers and peripheral units, it is often necessary or desirable to add to an existing system with additional peripherals, and these peripherals must carry and receive the same power and signal information going to the units of the existing system.

In the prior art, it was necessary to interconnect the various electronic units by cables carrying a large plurality of conductors. These cables have necessarily been shielded to avoid radio frequency interference, often making them unwieldy and appreciably increasing the cost to the user.

There has been a considerable amount of technology developed relative to the interfacing of computer and peripheral units. For example, see U.S. Pat. Nos. 3,881,174 and 4,286,319. While addressing certain problems relating to interfacing, these prior patents do not address the problems outlined above and to which the present invention relates.

SUMMARY OF THE INVENTION

The apparatus and method of the present invention solve the problems of cable interfacing between computer and peripheral units by providing a means for direct connection of component units by stacking, with adjustable multi-contact connectors of each unit oriented appropriately to mate with the adjacent unit and connect all stacked units as to power and signal information. The invention also generally encompasses the interfacing of any plurality of electrical components in this way and using the subject apparatus.

According to the invention, a connector component for an electronic unit for interconnecting a series of such units wherein power and signals are to be interconnected includes a frame for the component with means for securing the frame into the housing of an electronic unit. A pair of multi-contact connectors are associated with the frame, one serving as an input connector and one as an output connector.

A pair of swivel mounts are provided, one secured to each multi-contact connector, one being located at the top of the frame and one at the bottom of the frame. Means are provided in association with the swivel mounts and the frame for pivotally connecting each swivel mount on the frame such that the multi-contact connector and the mount are afforded limited swivelling movememt through substantially 90 degrees, from a horizontal orientation facing outwardly of the unit to a vertical orientation in position to be electrically connected directly to an adjacent unit stacked vertically therewith and having mating multi-contact connectors.

Inside the frame are internal flexible means for electrically connecting the pair of multi-contact connectors of the connector component to each other and into the electronic unit.

With this apparatus, a series of such electronic units may be stacked together, with adjacent mating multi-contact connectors oriented to the vertical position and mated together in electrical contact. Units at the top and the bottom of the stack may have their unmated multi-contact connectors swiveled to the horizontal position, in which each may be connected to a cable leading to other units remote from the stack.

Preferably, the multi-contact connectors comprise pin connectors, with the pin connector at the bottom of the frame being a male connector with pins and acting as the input connector, and with the top pin connector being a female connector with pin sockets and acting as an output connector.

A method according to the invention includes mounting the input and output multi-contact connectors on swivel mountings journalled in a frame member secured to a component unit, to enable rotation between a horizontal orientation and a vertical orientation. The pair of input and output connectors on the frame are internally connected by a flexible connector cable, and a further flexible cable extends from one of the multi-contact connectors internally into the operable portion of the electrical component unit, so that swivelling rotation of the swivel mountings is permitted while maintaining electrical connection.

In accordance with the method, the swivel mountings are rotated to the vertical position on some of the component units for direct connection between units and at least two of the units are stacked vertically together and the multi-contact connectors are directly mated between adjacent stacked units, without connector cables between them. At least one of the unmated pin connectors, at the top and bottom of the stack, is rotated to the horizontal position facing outwardly for interconnection by a cable to other, remote electrical component units.

In this way, every component unit in a system is connected in parallel to all conductors carrying power and signal information, and the use of additional cables is avoided while enabling units to be arranged in a compact, stacked configuration.

It is therefore one of the objects of the invention to eliminate unnecessary connector cable busses in the interfacing of a plurality of computer and peripheral units, or other electrical component units, and to provide a means for compactly stacking a series of units, saving in cost, RF interference problems, and space requirements. These and other objects, advantages, features and characteristics of the invention will be apparent from the following description of a preferred embodiment, considered along with the accompanying drawings.

DESCRIPTION OF THE DRAWINGS

FIG. 5 is a partial elevation view of the connector component, as it would be seen from the inside of an attached electrical component unit, i.e. showing the back side or inside appearance of multi-contact connectors associated with the connector component.

FIG. 6 is a sectional elevation view of the connector component, as seen along the line 6—6 in FIG. 5.

DESCRIPTION OF A PREFERRED EMBODIMENT

Figure 1:
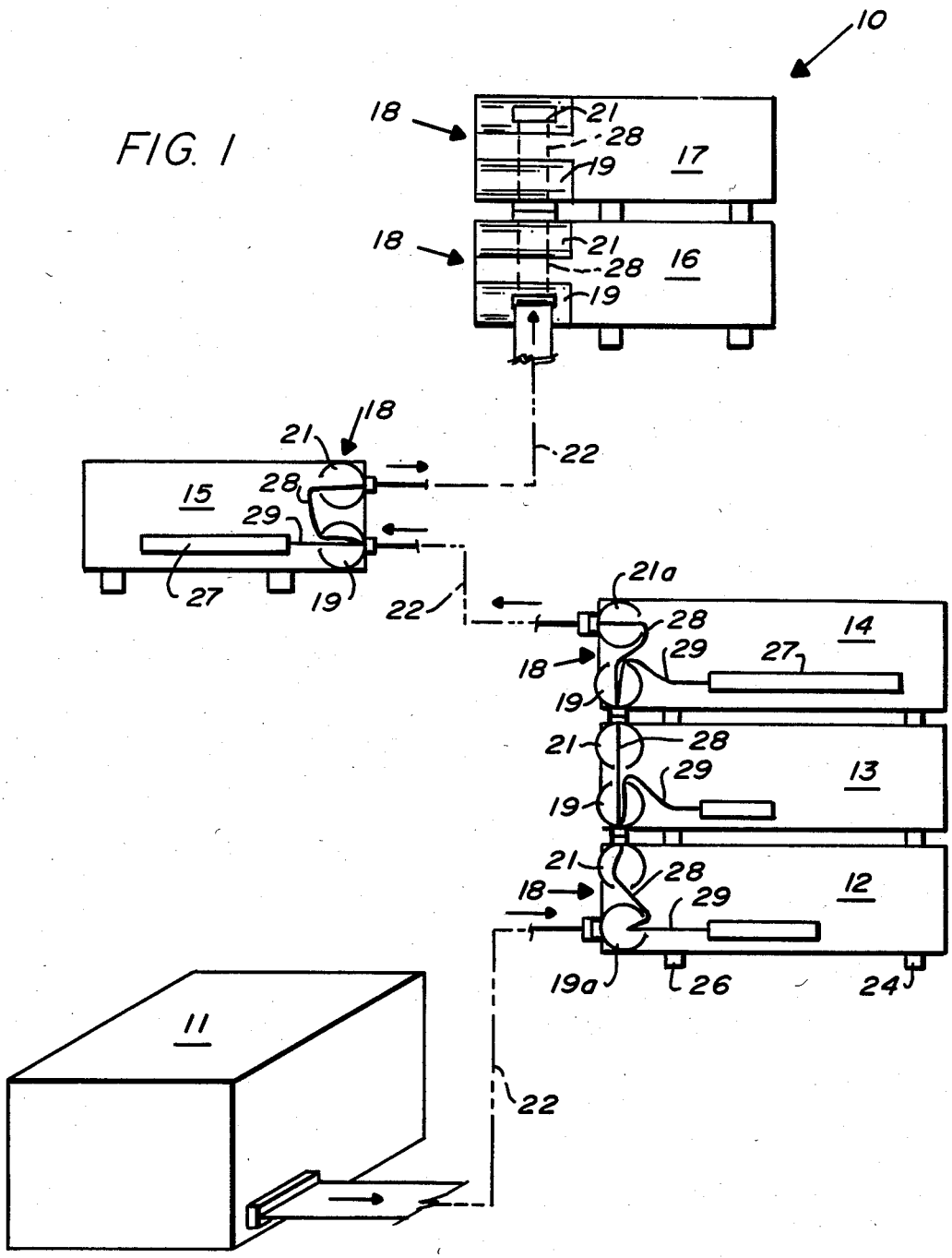
FIG. 1 is a schematic representation showing the apparatus of the invention interconnecting a series of electrical component units, some by direct stacking and mating of electrical connectors, and some connected by cables leading to locations remote from the stack.

In the drawings, FIG. 1 shows a system 10 according to the invention wherein a series of electrical component units 11, 12, 13, 14, 15, 16 and 17 are interconnected by apparatus which also forms a part of the invention.

The interfaced units 11–17 may comprise, for example, a host computer unit 11 and a series of peripheral units 12–17, which may include a power supply, disk drives (floppy or hard disk), tape back-ups, a printer, other computers, etc.

Each electronic component unit 12–17 shown in the exemplary system 10 of FIG. 1 includes a connector component 18 of the invention, attached at one end of the component unit, preferably at the back side of the unit. As indicated schematically in FIG. 1, each connector component 18 includes both an input connector 19 and an output connector 21, and these are on swivel mountings as explained in further detail below so that they can be rotated through substantially 90 degrees to either a horizontal, rearwardly or outwardly facing position or a vertical orientation. In the stack of component units 12, 13 and 14, the topmost connector component 21*a* at the top of the upper unit 14, which may be called an output component, is in the horizontal, outwardly facing orientation. Similarly, the lowermost connector 19*a*, which may be called an input connector, is oriented in the same manner. This is preferred when the connector does not interface directly with an adjacent unit above or below. Instead, the connectors 21*a* and 19*a* are each connected by a cable 22 to another electronic component 15 or 11, as illustrated in FIG. 1.

The remaining connectors in the stack of three units 12, 13 and 14, on the other hand, are oriented vertically, the input connectors 19 facing downwardly and the outward connectors 21 facing upwardly. The connectors 19 and 21 include multi-contact connectors, such as male and female pin connectors, which carry a large plurality of conducting paths which may include the carrying of both power and signal information. As indicated schematically in FIG. 1 for the stack of units 12–14 and the stack of two units 16 and 17, the adjacent vertically oriented connectors 19 and 21 are mated together directly, effected by the stacking process itself. This enables a considerable saving in cost by avoidance of additional connector cables 22, avoids associated potential problems relating to RF interference with such cables 22, and also enables an efficient use of space with units stacked compactly together.

As also indicated in FIG. 1, the electrical component units (or peripherals) 12, 13, 14, etc. may each include front 24 and rear 26 "feet", and when the units are stacked directly, the front feet 24 of upper units contact the immediately adjacent unit below, while the interconnection of the connectors 19 and 21 actually supports the stack at the rear.

Each of the swivel-mounted connectors 19 and 21 of each connector component 18 must be internally wired together and also to a logic board 27 or other internal operable device of each component unit 12–17, as indicated, for example, in the unit 14. This will enable all of the electrical component units to have their operative internal apparatus interconnected in parallel via a multiplicity of conductors. According to the invention, this is achieved by a first internal flexible flat cable bus 28 leading from the input connector 19 to the output connector 21, and by a second internal flexible flat cable bus 29 which leads from one of the connectors indicated in the figure as the input connector 19 to the internal logic board or other working portion 27 of the respective unit.

Figure 2:
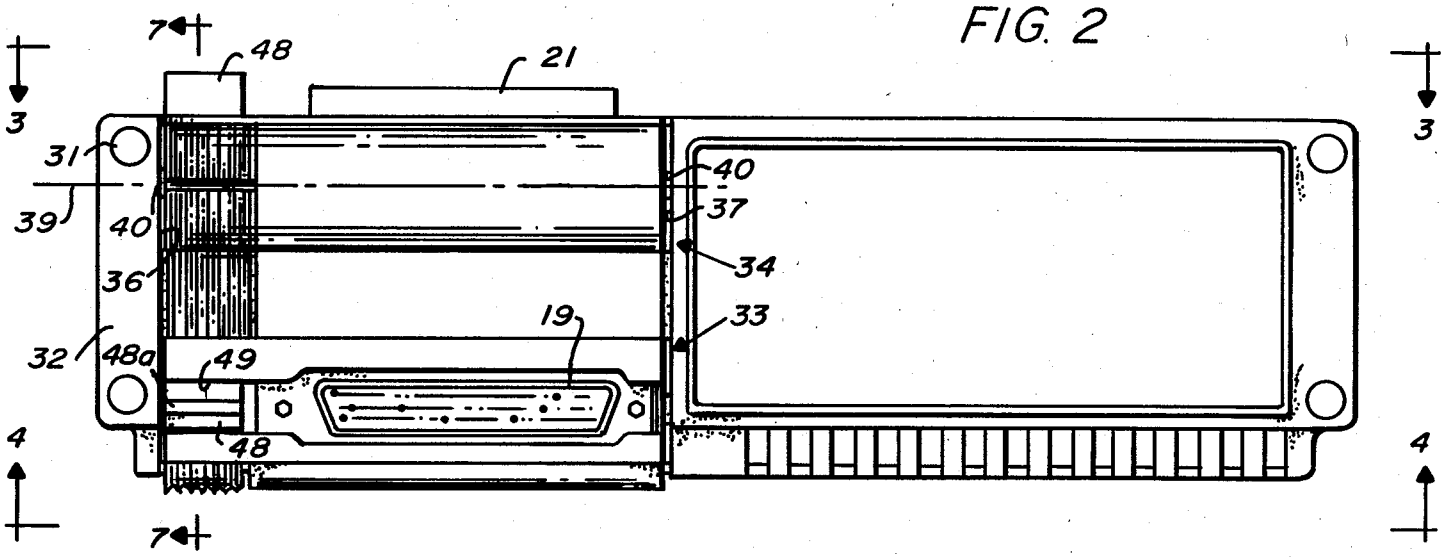
FIG. 2 is an elevation view of a connector component according to the invention, for connection to a housing of an electrical component unit, as viewed from what would be the rear of the entire electrical component unit including the connector component.
Figure 3:
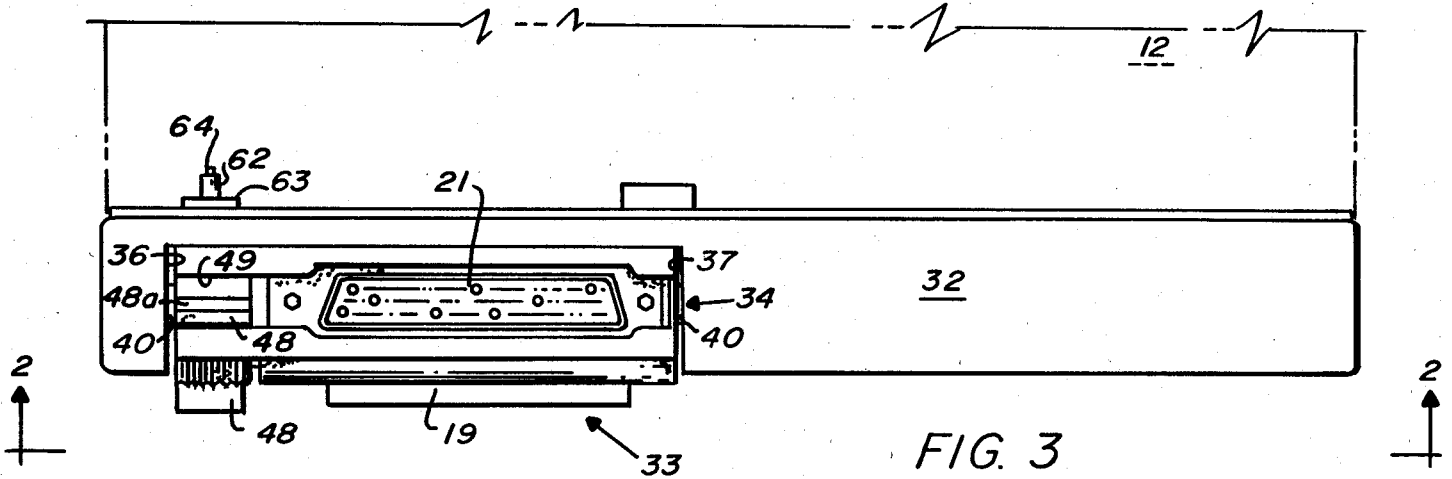
FIG. 3 is a plan view showing the top of the connector component.
Figure 4:
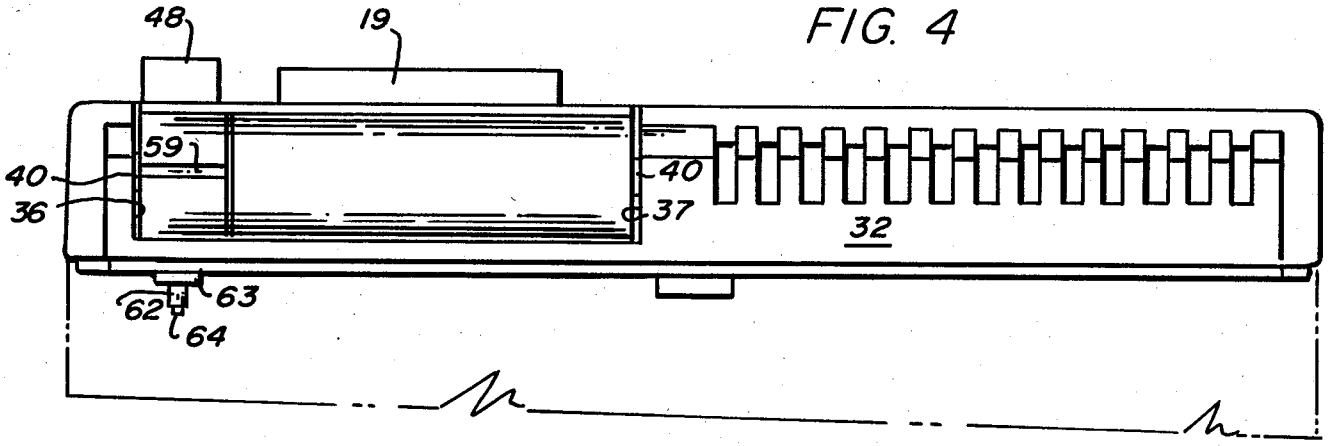
FIG. 4 is a bottom plan view of the connector component of the invention.

FIG. 2 is an elevation view showing the outside of a connector component 18, which would be the back side of the component 18 when it is secured to a computer peripheral or other electrical component unit. It may be secured thereto by a plurality of openings 31, which receive threaded fasteners connecting to the housing of the component unit. The connector component 18 has a frame 32 which supports the input and output connectors 19 and 21 on swivel mounts 33 and 34 journalled for rotation with respect to the frame 32. In FIG. 2 and in FIG. 3, which is a top view, the lower swivel mount 33 and connector 19 are in the horizontal position facing outwardly of the component unit 12, while the upper swivel mount 34 and connector 21 are swivelled to the vertical position, facing upwardly, for direct connection to the next component unit 13.

The construction of the connector component 18 according to the invention is best understood with reference to all of FIGS. 2 through 8. The frame 32 may be a cast metal piece having spaces toward one side for receiving the swivel mounts 33 and 34. These spaces may be defined between left and right partial walls 36 and 37 having pairs of pivot nipples 38 extending inwardly from the walls along an axis of rotation 39 of the swivel mounts. These pivot nipples 38 engage in cylindrical sockets 41 formed in each end of each swivel mounting 33 and 34, and there may be included a bushing 40, as of plastic material, between each nipple and socket.

Figure 7:
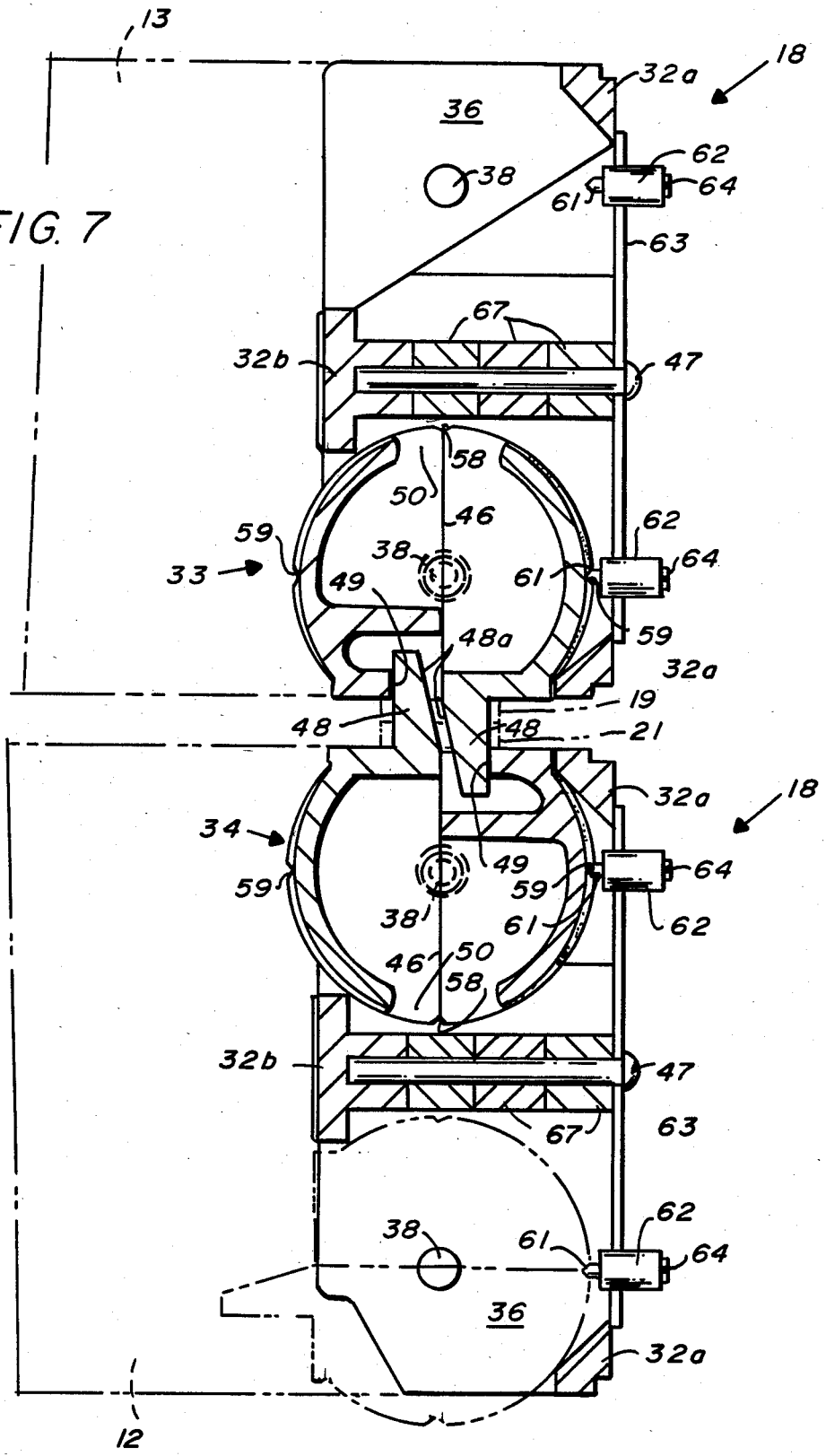
FIG. 7 is another sectional elevation view, but as seen along the line of 7—7 in FIG. 5 and showing the stacked interconnection of two electrical component units which are nested and mated together in the stacked configuration.

The sockets 41 are formed when each swivel mount 33 or 34 is assembled by connecting two halves 43 and 44, split along a center line 46, as shown particularly in FIGS. 6 and 7. The two halves may be connected by threaded fasteners extending through the swivel mounts and indicated at 47 in FIG. 6.

As shown in the figures, each swivel mount includes a radially outwardly extending stud 48, and adjacent to the stud, a receiving recess 49 (see FIGS. 2, 3 and 7) for receiving the stud of an adjacent stacked unit. These studs and recesses are preferably at one end of each swivel mount 33 and 34, as indicated. With these mating studs and recesses, the units such as the units 12 and 13 shown in FIG. 7 are closely nested together when stacked. FIG. 7 shows two of the connector components 18 in elevational section cut near the end of the swivel mounts, at the location of the studs 48 and recesses 49, as indicated by the cutting plane 7 shown in FIG. 5. Although FIG. 7 and other figures show the connector components at the rear of the units 12 and 13, they may be at other locations on the units still according to the invention.

The sectional view of FIG. 7 shows the connector components 18 with some of the swivel mounts removed. The upper swivel mount 34 of the lower unit 12 is shown mating and nesting with the lower swivel mount 33 of the upper unit 13, both swivel mounts being in the vertical, mating position. The stud 48 of each swivel mount nests into the recess 49 of the adjacent swivel mount, and the studs may include somewhat inclined surfaces 48*a* as shown, to generally guide the two components into correct mating position. As these studs and recesses are nested together the two associated connectors 21 and 19 (in dashed lines in FIG. 7) are properly joined together, and the two units are thereby electrically connected.

Figure 8:
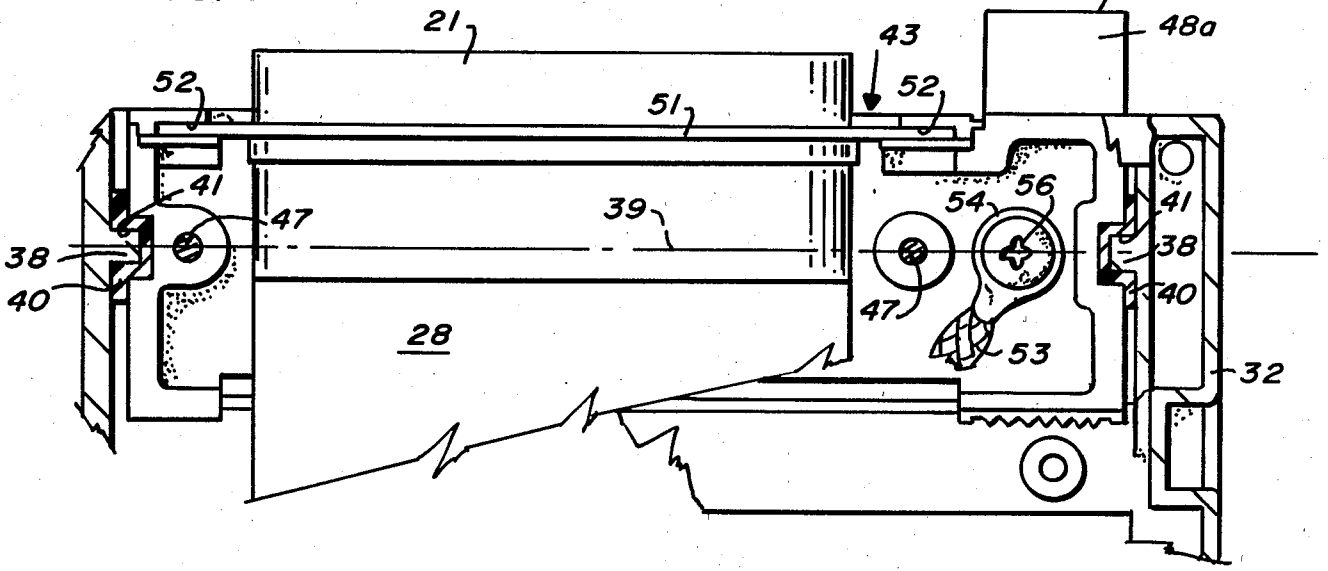
FIG. 8 is a detailed view in section longitudinally through a swivel mount, generally as viewed along the line 8—8 in FIG. 6, and showing one of the swivel mounts carrying its multi-contact connector, and the manner in which it is journalled in the frame of the connector component.

FIG. 8 is an enlarged detailed view of a portion of the connector component 18, cut through the swivel mount 34 as indicated by the line 8—8 in FIG. 6, so that the assembly appears as if the one half 44 of the swivel mount has been removed, showing the other half 43 which carries the nesting stud 48. As illustrated in both FIG. 6 and FIG. 8, the swivel mount half 43 is generally in the shape of a half cylinder, with some portions open. The multi-contact connector 21, in this case an output connector, has a flange 51 at both ends and around its perimeter, which is nested in a groove 52 formed in the swivel mount half 43 as indicated. Similar grooves are in both the halves 43 and 44 of the swivel mount, on either side of an opening provided for the connector 21. When the swivel mount 34 is assembled, the connector 21 is captured between the two halves 43 and 44 via its peripheral flange 51. The same is true with respect to assembly of the lower input swivel mount 33 on each connector component 18.

Also shown in FIGS. 6 and 8, as well as some of the other figures, is the flexible cable bus 28 and 29 which internally interconnects the two connectors 19 and 21, and the flexible cable bus 29 connecting the input connector 19 to the internal electronics of the electrical component unit to which the connector component 18 is secured. As indicated in FIG. 6, each of the swivel mounts has a rear opening 50 through which the bus or buses pass.

As can be envisioned from FIGS. 6 and 8, the two halves 43 and 44 of the swivel mount 34 are assembled in place in the frame 32, so as to assemble and close the two pivot sockets 41 over the pivot nipples 38 extending from the frame, with the bushing 40 first placed on the nipples 38.

FIG. 8 also shows a portion of a metal grounding cable 53 which is secured to the swivel mount via a threaded boss 54 and a fastener 56. The other end (not shown) of the ground cable 53 is to be secured to the housing or frame of the electrical component unit to which the connector component 18 is attached.

FIG. 6 and FIG. 7 illustrate a means for releasably locking the swivel mounts 43 and 44 in each of the two 90 degree-separated positions of use, i.e. the vertical position and the horizontal position. This may comprise a groove or recess 58 formed in the external surface of the swivel mount opposite the connector 21, and grooves or recesses 59 at the two positions 90 degrees removed from the groove 58. Three such grooves are provided, since it is preferable that the same swivel mount structure be used for the lower swivel mount 33 as for the upper swivel mount 34. As can be seen from FIG. 6, between the two mounts all three grooves 58 and 59 will be used in the two positions available for each swivel mount.

The grooves or recesses 58 and 59 are engaged by a spring-loaded reciprocable holding device 61 positioned adjacent to each swivel mount. The spring-loaded device 61 may be, for example, a spring ball or plastic or teflon plunger, such releasable holding devices being well known in various arts.

The holding device 61 is in a small housing 62 which may be secured to the frame 32 via a relatively narrow elongated plate or metal strip 63 through which the spring housing 62 is secured. Each housing 62 preferably includes a set screw 64 for adjusting the tension in the internal spring (not shown) operating the ball or plunger 61. The mounting plate or strip 63 may rest against corner components 32*a* of the frame 32 at the top and bottom of the connector component 18 as shown. It may be retained in this position by a threaded fastener 66 extending through the plate and into a frame portion 32*b* at the other side of the assembly, with an appropriate spacer or spacers 67 interposed therebetween and surrounding the fastener 66.

The pin connectors 19 and 21 shown in the drawings may be termed input and output connectors as mentioned above. The input connector 19, in accordance with the usual convention, may be a male connector, such as a pin connector with pins. The output connector 21 accordingly may be a female pin connector with pin sockets. Actually both connectors 19 and 21 carry all information associated with the entire system, such as all power and signal information in the case of computers and peripherals, and either may actually may lead to either a driving unit or a servo unit. Although pin connectors are shown herein, any other form of multi-contact connector may be used, wherein a pair of connectors (which may not be male and female) can be mated together. The term "multi-contact connector", as used in the claims, means any such suitable mating connector.

Also, the terms "up", "down", "vertical", "horizontal", etc. are used for convenience herein and in the appended claims in referring to the invention in its preferred form and as shown in the drawings. It should be understood that other orientations of the components and system of the invention may be useful in some applications are intended to be within the scope of the claims.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims:

We claim:

1. A connector component for computer units and peripheral units, secured to housings of the units for conveniently interconnecting them with respect to power and signals and for connecting them to other units, comprising:

a frame for the component, with means for securing the frame into the housing of one of said units, a pair of pin connectors, one male and one female, a pair of swivel mounts, one secured to each pin connector, one at the top of the frame and one at the bottom of the frame, with means pivotally connecting each swivel mount on the frame such that the pin connector and the mount are afforded rotational movement through substantially 90 degrees from a horizontal orientation facing outwardly of the unit to a vertical orientation in position to be connected directly to an adjacent unit stacked vertically therewith and having mating pin connectors, and internal flexible means for electrically connecting the pair of pin connectors of the connector component together and into the unit, whereby a series of such units may be stacked together, with adjacent mating pin connectors oriented to the vertical position and connected together, and whereby units at the top and bottom of the stack may have their unmated pin connectors swiveled to the horizontal position, in which they may be connected by cables to other units.

2. The connector component of claim 1, further including means associated with the frame of each connector component for nesting the component with an adjacent component when units are stacked together.

3. The connector component of claim 2, wherein the nesting means comprise mating studs and recesses associated with the swivel mounts, and located adjacent to and oriented similarly to a pin connector.

4. The connector component of claim 1, wherein each swivel mount includes, adjacent to its pin connector, a stud and a recess positioned so that the stud enters a recess of an adjacently stacked connector component while the recess receives a stud of the adjacently stacked component, for nesting the components together in vertical stacking.

5. The connector component of claim 4, wherein the studs and recesses are elongated and generally rectangular, providing an orienting function for the adjacently stacked units with respect to each other.

6. The connector component of claim 4, wherein the swivel mount comprises a generally cylindrical body having a central cavity and formed of two parts held together with removable fastening means, each part generally comprising a half cylinder, and wherein the recess is formed between the two parts when they are connected by the fastening means.

7. The connector component of claim 6, wherein each of the two parts includes a recess forming an opening for the pin connector, the pin connector having a peripheral flange and the two parts having a recess around the pin connector opening, positioned to receive the flange and to tightly retain the pin connector in the central cavity of the body, oriented outwardly, when the two parts are connected by the fastening means.

8. The connector component of claim 1, wherein each swivel mount comprises a generally cylindrical body having a central cavity and formed of two parts held together by removable fastening means, each part generally comprising a half cylinder.

9. The connector component of claim 8, wherein each of the two parts includes a recess forming an opening for the pin connector, the pin connector having a peripheral flange and the two parts having a recess around the pin connector opening, positioned to receive the flange and to tightly retain the pin connector in the central cavity of the body, oriented outwardly, when the two parts are connected by the fastening means.

10. The connector component of claim 1, wherein said flexible internal means comprises a first flat cable bus extending between the back sides of the two pin connectors of the component, and a second flat cable bus extending from the back side of one of the pin connectors and having an opposite end with means for electrical connection into the unit on which the connector component is secured.

11. The connector component of claim 1, wherein the means pivotally connecting the swivel mount on the frame comprises a pair of pivot nipples for each swivel mount, extending toward one another from the frame on a pivot axis of the swivel mount, the swivel mount including a pair of recesses on said pivot axis on opposite ends of the swivel mount, receiving the pivot nipples.

12. The connector component of claim 11, wherein the swivel mount comprises two halves divided along a plane containing said pivot axis, the two halves when assembled together forming said recesses on the pivot axis.

13. The connector component of claim 12, wherein the swivel mount comprises a generally cylindrical body with a central cavity containing the pin connector oriented outwardly through an opening, each half of the swivel mount generally comprising a half cylinder.

14. The connector component of claim 13, wherein one half of each swivel mount has an outwardly extending stud and the other half includes flanges forming a recessed area which, when the two halves are joined together, forms a recess, the stud and recess being adjacent and positioned and oriented to receive a mating stud and recess of an adjacently stacked connector component and unit to nest the connector components together.

15. The connector component of claim 1, further including means for releasably holding the swivel mount in the vertical or the horizontal position.

16. The connector component of claim 15, wherein the releasable holding means comprises a detent in the swivel mount at each of two positions 90 degrees apart, and a spring-loaded reciprocable holding device positioned in the frame for engaging in either of the detents and for being retracted when the swivel mount is manually forced to rotate out of a held position.

17. A connector component for an electronic unit for interconnecting a series of such units wherein a plurality of conductive paths are to be interconnected, comprising, a frame for the component, with means for securing the frame into the housing of an electronic unit, a pair of multi-contact connectors, one serving as an input connector and one as an output connector, a pair of swivel mounts, one secured to each multi-contact connector, one at the top of the frame and one at the bottom of the frame, with means pivotally connecting each swivel mount on the frame such that the multi-contact connector and the mount are afforded limited swivelling movement through substantially 90 degrees, from a horizontal orientation facing outwardly of the unit to a vertical orientation in position to be electrically connected directly to an adjacent unit stacked vertically therewith and having mating multi-contact connectors, and internal flexible means for electrically connecting the pair of multi-contact connectors of the connector component to each other and into the electronic unit, whereby a series of such units may be stacked together, with adjacent mating multi-contact connectors oriented to the vertical position and mated together in electrical contact, and whereby units at the top and bottom of the stack may have their unmated multi-contact connectors swiveled to the horizontal position, in which each may be connected to a cable leading to other units remote from the stack.

18. A connector component according to claim 17, wherein the multi-contact connectors comprise pin connectors.

19. A connector component according to claim 18, wherein the pin connector at the bottom of the frame comprises the input connector and is a male pin connector with pins, and the top pin connector comprises the output connector and is a female pin connector with pin sockets.

20. A connector component according to claim 17, further including means associated with the frame of each connector component for nesting the component with an adjacent component when units are stacked together.

21. The connector component of claim 20, wherein the nesting means comprise mating studs and recesses associated with the swivel mounts, and located adjacent to and oriented similarly to a pin connector.

22. The connector component of claim 21, wherein each swivel mount includes, adjacent to its multi-contact connector, one of said studs and one of said recesses positioned so that the stud enters a recess of an adjacently stacked connector component while the recess receives a stud of the adjacently stacked component.

23. The connector component of claim 22, wherein the studs and recesses are elongated and generally rectangular; providing an orienting function for the adjacently stacked units with respect to each other.

24. The connector component of claim 21, wherein the mating studs and recesses include orienting means for assuring proper adjustment of the stacked units.

25. The connector component of claim 17, wherein each swivel mount comprises a generally cylindrical body having a central cavity and formed of two parts held together by removable fastening means, each part generally comprising a half cylinder.

26. The connector component of claim 25, wherein each of the two parts includes a recess for receiving a peripheral flange of the multi-contact connector, positioned such that when the two parts are connected by the fastening means, the multi-contact connector is retained tightly in the central cavity of the body, oriented outwardly, with the peripheral flange retained in the recess.

27. The connector component of claim 17, wherein said flexible internal means comprises a first flat cable bus extending between the back sides of the two multi-contact connectors of the component, and a second flat cable bus extending from the back side of one of the multi-contact connectors and having an opposite end with means for electrical connection into the unit on which the connector component is secured.

28. The connector component of claim 17, further including means for releasably holding the swivel mount in the vertical or the horizontal position.

29. The connector component of claim 28, wherein the releasable holding means comprises a detent in the swivel mount at each of two positions 90 degrees apart, and a spring-loaded reciprocable holding device positioned in the frame for engaging in either of the detents and for being retracted when the swivel mount is forced manually out of a held position.

30. A method for connecting a series of electrical component units wherein a multiplicity of electrical conductors are to be connected in parallel among the units, comprising:

mounting input and output multi-contact connectors on swivel mountings journalled in a frame member secured to the component unit for rotation through about 90 degrees from a horizontal orientation facing outwardly of the unit to a vertical orientation in position to be electrically connected directly to an adjacent unit stacked therewith, the swivel mountings being at the bottom and top of the frame, connecting the input and output connectors internally with a flexible connector cable, and providing another flexible connector cable extending from one of the multi-contact connectors for connection internally into the electrical component unit, to permit swivelling rotation of the swivel mountings while maintaining electrical connection, rotating the swivel mountings of some of the component units vertically for direct connection between units, stacking at least two units vertically together and directly mating the multi-contact connectors of the adjacent stacked units without external connector cables between them, and rotating at least one of the unmated connectors and the associated swivel mounting to the horizontal position facing outwardly for interconnection by a cable to other remote electrical component units.

31. The method according to claim 30, wherein the multi-contact connectors are male and female pin connectors.

32. The method according to claim 30, wherein the electrical component units are computer and peripheral units, with the multi-contact connectors carrying both power and signals in parallel among the units.

* * * * *